US005615614A

United States Patent [19]

Van Pelt

[11] Patent Number: 5,615,614

[45] Date of Patent: Apr. 1, 1997

[54] THERMOGRAPHY PROCESS AND APPARATUS

[75] Inventor: Christopher K. Van Pelt, Nokomis, Fla.

[73] Assignee: Van Pelt Equipment Corporation, Nokomis, Fla.

[21] Appl. No.: 415,632

[22] Filed: Apr. 3, 1995

[51] Int. Cl.[6] ..... B41J 3/02

[52] U.S. Cl. ..... 101/488; 219/216; 219/388; 34/634; 34/242; 34/86; 34/572

[58] Field of Search ..... 101/488, 487, 101/227; 219/216, 388; 34/86, 242, 572, 634

[56] References Cited

U.S. PATENT DOCUMENTS

| | | | |
|---|---|---|---|
| 3,526,207 | 9/1970 | Nadelson . | |
| 3,745,307 | 7/1973 | Peek, Jr. et al. | 219/388 |
| 4,075,455 | 2/1978 | Kitamura et al. . | |
| 4,161,644 | 7/1979 | Yawagawa et al. | 219/216 |
| 4,180,721 | 12/1979 | Watanabe et al. . | |
| 4,414,913 | 11/1983 | Sarda . | |
| 4,514,779 | 4/1985 | Wilkinson . | |
| 4,551,006 | 11/1985 | Elvin | 219/216 |
| 4,698,504 | 10/1987 | Van Pelt . | |
| 4,745,430 | 5/1988 | Tsuchiya | 219/216 |
| 4,766,677 | 8/1988 | Brooks et al. | 34/242 |
| 4,792,246 | 12/1988 | Van Pelt . | |
| 4,801,974 | 1/1989 | Suto et al. | 219/216 |
| 4,805,531 | 2/1989 | Sarda | 101/488 |
| 4,959,529 | 9/1990 | Matsumoto et al. | 219/388 |
| 4,981,433 | 1/1991 | Matsumoto et al. | 219/216 |
| 5,386,272 | 1/1995 | Nakazato | 219/216 |
| 5,770,215 | 12/1992 | Pfeuffer | 219/216 |

*Primary Examiner*—Eugene H. Eickholt

*Attorney, Agent, or Firm*—St. Onge Steward Johnston & Reens LLC

[57] ABSTRACT

A thermography machine to be subject in use to periods of waiting for supplies of sheets to be processed is provided with a control system whereby at any time the conditions of a normal "run" mode of operation can be switched to or from operations in a "standby" mode, with retention of a high heating chamber temperature in readiness for processing sheets yet with important reductions of heat losses from the heating chamber, so reduced infusion of heat into the ambient workshop air, and decreases of power consumption and of wear and deterioration in the driving of the conveyors and several other components of the machine. Heating chamber temperature and wattage output of the heaters are controlled over a wide range of A.C. supply line voltages in both modes of operation by supplying current to the heaters from a thermocouple heat control coupled with a proportional voltage control. Heat losses and power usage during standby periods are greatly reduced by curtailing the speed of driving of the conveyors to an abnormally low rate, and further by disposing insulating doors across the passageways for sheets transport at the ends of the heating chamber. An "automatic" mode of operation of the machine is also provided, so that the switchings between its "run" mode and its "standby" mode of operation will be effected in response to cessations and resumptions, respectively, of operating conditions of a sheet-fed printing press that delivers sheets imprinted for processing in the thermography machine.

25 Claims, 4 Drawing Sheets

THERMOGRAPHY PROCESS AND APPARATUS

FIELD OF THE INVENTION

This invention relates to thermography, sometimes known as "raised printing."

DESCRIPTION OF PRIOR ART

In the basic thermography process, sheets of suitable material such as paper bearing image areas overlaid with powder particles which typically are made of thermoplastic resin, are transported successively through a heating chamber in which the powder particles on each sheet are heated sufficiently to fuse them together into raised image portions fixed to the sheet. The sheets then are passed through a cooling station in which, while being held down onto a conveyor by suction, an air flow from above cools them to solidify the fused image portions.

Typically, the image areas to be overlaid with the powder particles are formed by a printing press that imprints the sheets with liquid ink and delivers them one by one, while the ink is still wet or tacky, onto a conveyor system of the thermography machine. A conveyor then carries each sheet through a powdering station where a vibrated hopper delivers the resin powder down onto the face of the sheet. Then the sheet is passed beneath a vacuum pick-up head that removes and recycles excess powder not adhered to the sheet by tacky image areas. Then each sheet is conveyed through the heating chamber, often called a "heat tunnel", where heat applied at a high temperature from electrical resistance heating elements melts the adhered resin powder so that it forms a smooth layer fused onto each of the previously powder-covered image areas.

The heating temperature applied is so high that the resin particle held on image areas of each sheet will be fused together and onto the sheet in a very short time of passage of the sheet through the heating chamber. The machine and process thus can be economical in production speed and output. Generally, the temperature of the sheet itself must be raised to above 200° F., and the heating temperature used for economical production needs to be in the range of about 1000° to 1200° F.

In thermography workshops, typically various jobs are processed each day by periods of operations of each machine for making different products. Various intervals of unproductive machine running time, often unpredictable in duration, occur in standby periods between the jobs, when the machine though readied for the processing operations stands awaiting a supply of sheets to be processed. Since the start-up heating necessary to make a machine ready for the processing operations is time-consuming and costly in energy, each thermography machine expected to be in service in a workday ordinarily is turned on in the morning and left running all day. Consequently, very large amounts of electrical energy are consumed not only for each machine's operations but, additionally, for air conditioning that often is needed to keep ambient temperature conditions acceptable in the workroom.

SUMMARY OF THE INVENTION

The principal object of the present invention is to provide a method and apparatus whereby the thermography process can be carried out efficiently with important savings and important conservation of energy through reduced consumption of electrical power in the operations of the thermography machine and reduced infusions of heat from the machine into the workroom.

Another object is to provide a control system by means of which a preset high temperature for fusing the power particles on sheets being passed through the machine can be maintained accurately in the heating chamber of the machine even though large variances may exist in voltages of the power supply for the heating elements of the machine.

According to this invention, during the standby periods in which the thermographic equipment readied for processing sheets stands awaiting a supply of sheets to be processed, a high temperature suited for fusing the thermoplastic powder particles onto image areas of sheets to be passed through the heating chamber is maintained in the heating chamber of the machine, yet the passage of heat out of that chamber and the energy input to the equipment are each curtailed to an abnormally low rate.

According to one feature of the invention, the conveyor provided for transporting sheets through the heating chamber is driven during the standby periods at an abnormally low speed that needs only be sufficient to avoid damage to the conveyor by the high temperature maintained in the heating chamber. In this way the conveyor, which typically is a mesh made of interlocked chains of stainless steel wire, carries far less heat out of the heating chamber for dissipation in the cooling station and the environs of the machine. Moreover, the low conveyor speed significantly obviates heat losses by reducing the conveyor's drag of air through the heating chamber. Still further, the lowered conveyor speed decreases the power consumption of the motor driving the conveyor, and will dramatically reduce wear and deterioration of the drive motor and the bearings and chains of the conveyor over the life of the machine.

In another feature of the invention, at least one and preferably both of the passageways for sheets transport that normally stand open at the infeed and outfeed ends of the heating chamber are held substantially closed during the standby periods of the machine operation. The hot air present in the heating chamber is thus obstructed from escaping it, so that relatively little of the air's high heat content is dissipated into the workroom. For this purpose, the passageways for sheets transport at opposite ends of the heating chamber preferably are each provided with an insulating door that is held in an open position away from the related passageway during normal running operations of the thermography machine but, during standby operating periods, is held displaced to a position across and substantially closing the passageway.

For carrying out this feature of the invention, a control system is provided which includes mechanisms for displacing the doors of the heating chamber away from their normal open position to a closed position across the passageways for sheets transport, together with a standby mode control circuit including a switch movable to activate the door closing mechanisms whenever the thermography machine, though previously running or readied for productive operation, stands awaiting a supply of sheets to be processed in it. In preferred embodiments of the invention, this control circuit includes a time delay means whereby the actual closing of the doors will occur only when a preset time interval, typically in the range of about 1 to 10 seconds, for example, of seven (7) seconds, has expired after movement of the control switch to place the system in standby mode. This provides a safeguard to make sure that any sheet or sheets that might be present in the heating chamber when the standby mode is initiated will have been conveyed out of the heating chamber before its doors become closed, so will not be trapped in it to catch fire or be burned there.

As an additional feature of the invention, a heater control system is provided by which the powder fusing temperature maintained in the heating chamber of the thermography machine is held accurately at or very near to a predetermined desired value notwithstanding variances of the A.C. power supply voltage which commonly occur at different machine locations, or even at a given location on different days or at different times of a day. The voltage may vary, for example, from as little as about 198 volts up to about 245 volts in uses of heaters with an A.C. power supply rated at 220 volts. In the present system, adverse effects of the voltage variances are overcome by making use of a thermocouple heat control that will transmit current to energize the heater(s) when a temperature deficiency is sensed by a thermocouple located in the heating chamber, together with a proportional heat control which upon a variation of the voltage in an A.C. power supply line will proportionately vary the on/off intervals of a cyclic supply of wattage to the thermocouple control.

For accurate performance of a thermocouple control, the heater(s) ordinarily would have to be wired accurately to fit the voltage of the incoming power supply. By virtue of the present combination, which may be termed a "dual tracking" heat control, the desired temperature set point accuracy is maintained within the heating chamber even when the supply voltage departs substantially from that for which the heater or heaters of the machine are designed. Thus, for example, by designing the heater(s) for operation at 100% efficiency with a supply voltage of 200 volts, the machine can be operated on an A.C. power supply at any voltage between about 200 and 245 volts yet with accurate control as the voltage varies of both the wattage output and the temperature in the heating chamber. Consequently, heaters of a single design can be provided for, and will give substantially the same performance and reliability in installations where the power supply voltages may differ or vary in values over a wide range.

According to another feature of the invention, the control circuit of the thermography machine is provided with switch means that respond to a condition of operation of a printing press that produces and delivers sheets imprinted for processing in the thermography machine, so that when the printing press is placed in operative condition to imprint and deliver such sheets the control circuit places and holds the thermography machine in its normal "run" mode of operation; while when the press ceases operation with its feeding of sheets discontinued, the control circuit will automatically switch the machine into the "standby" mode of operation. Thus, a condition existing when sheets are being delivered from the press will automatically cause the thermography machine to be kept in its "run" mode of operation, thus preventing a paper jam or a fire from occurring if an operator should forget or otherwise fail to switch the control system from "standby" mode to the "run" mode; and when sheets no longer are being fed by the press, an automatic switching of the machine to "standby" mode saves power, heat, and wear, that otherwise would be wasted if an operator should fail or forget to effect such switching.

Other objects, features and advantages of the invention will be evident from the following description and the accompanying drawings of a preferred embodiment of the invention.

DESCRIPTION OF PREFERRED EMBODIMENT

Figure 1:
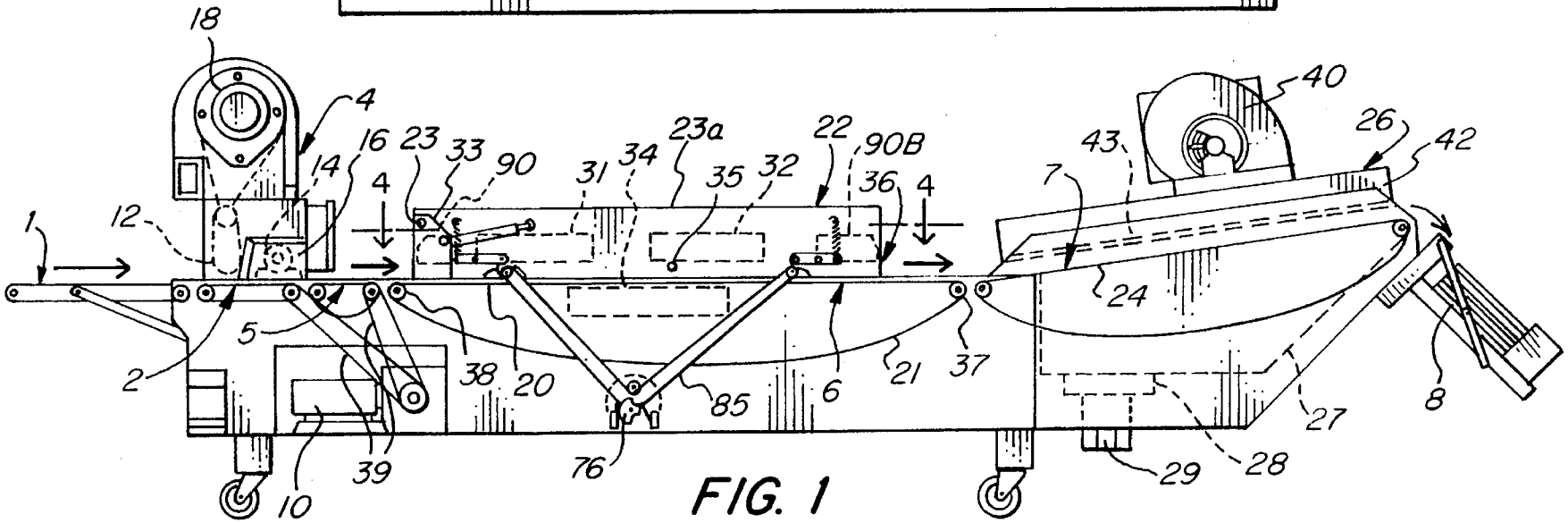
FIG. 1 is a side elevational view of a thermography machine making use of the invention.

As shown in FIG. 1 of the drawings, the illustrative thermography machine includes an infeed conveyor 1 by which sheets placed thereon face-up are passed successively onto the aligned upper flights of a series of endless conveyors 2, 5, 6 and 7. These conveyors carry the sheets forward for processing in the machine and for discharge onto a delivery tray 8.

Conveyor 2 is, for example, a wide rubber belt which carries each sheet through a powdering and powder recycling station 4. Conveyors 5, 6 and 7 desirably are each made of a highly heat-resistant wire mesh belt fabricated, for example, of stainless steel wires looped and chained together, with pointed flat strips inserted in some of the loops if desired as shown in U.S. Pat. No. 4,698,504.

The several conveyors are driven in conventional manner, e.g., by link chains, some being indicated at 39, in FIG. 1, which connect sprockets on the conveyors' respective driving rollers with a drive motor 10. This motor is a D.C. motor selected so that its speed and consequently the sheet-transporting speed of the conveyors will be governed by the voltage in a D.C. power supply that supplies current to motor 10 whenever the machine is operating.

The sheets to be processed in the thermography machine typically are delivered to it directly from a rotary offset printing press into which sheets to be imprinted are passed one by one, ordinarily by a sheet lifting and displacing suction device kept under suction by a motor-driven vacuum pump. The run and standby conditions of operation of the thermography machine can advantageously be coordinated automatically with operating periods and idle periods of the related sheet-fed printing press, for example, as described more particularly herein below.

Each imprinted sheet to be processed in the thermography machine is fed to the infeed conveyor 1 with ink still tacky on image areas of the sheet that are to be overlaid by a layer of fused resin. While the sheet passes on belt 2 through the powdering station 4, a suitable thermoplastic powder which typically is made of a nylon resin is sprinkled downward onto the sheet from a powder holding and dispensing hopper 12. This hopper is vibrated in well known manner by a vibrator motor 14. Then, as the sheet passes onto the first wire mesh conveyor 5, the powder particles not adhering to inked image areas are sucked away from the sheet via a suction head 16 into a cyclone 18 that separates the particles from the air stream and delivers the excess particles back into hopper 12 for application again to infeed sheets.

Each sheet so overlaid with the resin powder passes onto the upper flight 20 of conveyor 6, which carries the sheet through a heating chamber, or "heat tunnel" 22 and thence onto the upper flight 24 of conveyor 7 which carries the sheet through a cooling station 26 before delivering it onto tray 8.

In the heating chamber, the wire mesh conveyor flight 20 extends through an infeed end opening 30 that normally affords passageway for the sheets to be carried in on the conveyor, and thence along the chamber beneath electrical-resistance heaters 31 and 32 that radiate heat downwardly to the face of each sheet. A lower electrical resistance heater 34 desirably is also provided to radiate heat upwardly to the bottom of each sheet, as set forth more particularly in U.S. Pat. No. 4,792,246. Beyond the heaters, conveyor flight 20 passes through the outfeed end opening 36, which again normally affords open passageway for the sheets, and thence to and about a roller 37 for return to the infeed end 30 via a depending lower flight 21 that leads to and about a forward roller 38. The return flight 21 moves along a path away from the heaters, where it can give off excess heat absorbed in its wire mesh when in the heating chamber.

Additionally, the wire mesh of conveyor 6, instead of being made of stainless steel wire of about 0.062" in diameter as ordinarily used in conveyors of thermography machines, preferably is made of lighter stainless steel wire having a diameter, for example, of about 0.047". Consequently, the heat content of the conveyor wire mesh when passing out of the heating chamber 22, so the heat that it will carry into the ambient, is considerably less in amount than in prior practice.

It will also be noted that the backward roller 37 is positioned so that a considerable distance is provided for travel of conveyor flight 20 and the heated sheets beyond the heaters and beyond the outlet end opening 36 to the location where each sheet is to be held down to flight 24 of conveyor 7 in the cooling station.

A preset high temperature, e.g., of approximately 1100° F., is maintained in the heating chamber 22 so that the thermoplastic powder particles remaining on each sheet when it enters chamber 22 will be fused together and onto the sheet during a short time of travel of the sheet through chamber 22. The sheet itself becomes heated to a temperature above 200° F. in that time period. The applied powder of course reaches a temperature much higher and above its melting point.

The required high heating temperature is maintained reliably under the control of a thermocouple 35 which is located near the heaters in chamber 22 and works in conjunction with a thermocouple heat control unit 50 and a proportional heat control unit 52 connected with an A.C. power supply line 54. See FIG. 3. The thermocouple 35, being adapted to maintain the required high heating temperature, causes unit 50 to supply current for activating the heaters when the thermocouple senses a temperature deficiency. This control, however, would not prevent the heaters from producing too much wattage, so too high a temperature, when the voltage of the current supply varies so as to be higher than the maximum voltage for which the heaters were designed to provide the required wattage output. Yet by supplying the heating current through unit 52, which can be a control device of known construction such, for example, as a "proportional heat control" product No. 10875 of Thermo-O-Type Corp. located in Nokomis, Fla., the current input to unit 50 is supplied in pulses that vary in magnitude in inverse proportion to departures of the voltage in power supply line 54 from its rated value. Consequently, even though the heaters 31, 32 and 34 may be designed, for example, for the efficient use of current supplied at 200 volts, variances up to about 245 volts in line 54 can occur without reaching the thermocouple heat control or the heaters and a preset high heating temperature suited for fusing the applied resin powder to the sheets can be maintained quite reliably in the heating chamber.

As the heated sheets being processed pass backward from conveyor flight 20 at roller 37, each sheet is moved onto conveyor flight 24 in the cooling station 26 and is held down flat on this conveyor by a suction produced by air being drawn down through the conveyor's wire mesh into and then from a plenum chamber 27. A fan or blower 28 driven by a motor 29 produces the hold-down air flow, or suction, which continues during travel of each sheet through the cooling station until the sheet is passed over the backward end of conveyor 7 to fall onto the delivery tray 8. During such travel, additionally, an air blower or fan 40 forces air into a plenum chamber 42 from which many fine streams of cooling air are passed down onto the face of each sheet by passing through small openings in a perforated partition 43 that overlies the path of the cooling conveyor flight 24. The sheets when discharged onto the delivery tray thus have their thermographed image portions fused and solidified in place and are cool enough to be handled, packaged or used in any way desired.

The operations described above with reference to FIG. 1 of the drawings relate to steps and conditions involved in a "RUN" mode of operation of the thermography machine. They correspond largely to the operations of leading commercial thermograph machine but differ importantly in the manner of control of the current supply to the heaters and in the arrangement of the suction hold-down system well beyond the heating chamber.

Figure 3:
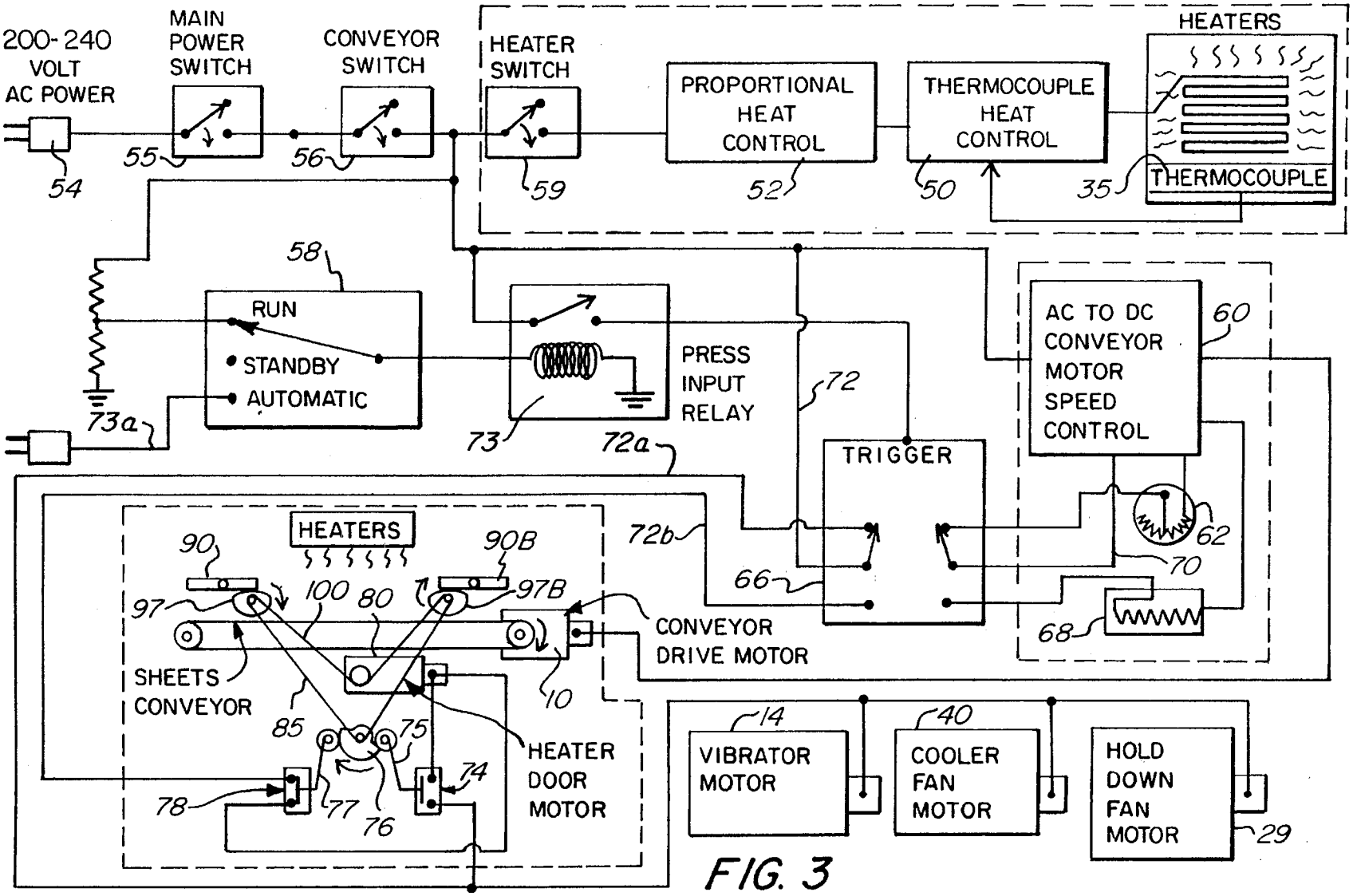
FIG. 3 is a schematic logic diagram of heat control and speed control circuits, controls for the heating chamber doors, and functions involved in the run and standby modes of operation of the machine.

Further according to the present invention, as indicated diagrammatically in FIG. 3, a "standby" mode of operation is provided which further distances the present machine and its manner of operation from previously known machines.

Figure 2:
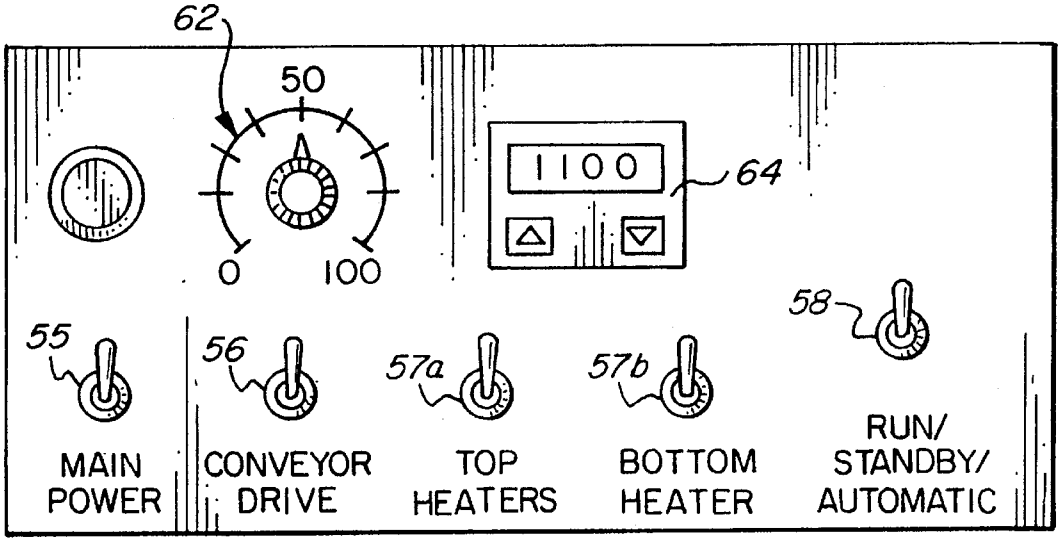
FIG. 2 is diagram of an operator's control panel for setting switches, a conveyor speed control and a heating temperature control of the machine.

In order to bring the machine into or ready it for the RUN mode of its operation, a RUN/STANDBY/AUTOMATIC switch 58 may be set in either RUN or AUTOMATIC position, and a main power switch 55 and a conveyor drive motor switch 56 are closed to pass current through a circuit from the A.C. power source 54 to an AC to DC rectifier in a conveyor drive motor speed control unit 60 and thence, under control of a potentiometer 62, to the D.C. drive motor 10 that drives the machine's conveyors. By setting the potentiometer 62, a D.C. voltage is selected to drive the conveyor motor at the speed desired for the sheet heating and cooling operations required during the travel of the sheets to be processed through the machine. With the conveyor drive motor 10 activated so that conveyor 6 is running through and out of the heating chamber 22, a switch **57*a* or switches 57*a* and 57*b* (FIG. 2) may be closed to activate the heaters 31 and 32, or these and the bottom heater 34 too, by power supplied in a circuit through unit 59 and the control units 50 and 52. The powder fusing temperature to be maintained by the heaters can be preset and held at a required high level by setting an adjuster 64 (FIG. 2) that acts through the thermocouple heat control unit 50**.

Once the machine is readied for operations with the conveyors running and the required high heating temperature established in chamber 22, or when the machine is running idly upon completion of the processing of sheets for a given job, a delay may occur before sheets to be processed become available at the machine. In such event, switch 58 can be turned to its STANDBY position to put the machine in a standby mode of operation, thus causing the opening, e.g., via control relay 73, of a circuit to a time delay relay 66 which normally holds closed a control circuit through the potentiometer 62 to the conveyors' D.C drive motor 10. Equivalently, if the AUTOMATIC mode of operation has been provided and was selected as by a setting of switch 58, the delay relay 66 will be deenergized when the control relay 73 ceases to be energized via switch 58 and line 73*a* by current from a supply circuit that is energized when a printing press is operating to deliver sheets imprinted for processing in the thermography machine. Such a current supply circuit may be, e.g., that of a vacuum pump motor of the sheet feeder of the printing press.

The time delay relay 66 acts after a preset time sufficient to make sure that conveyor 6 will have carried out of the heating chamber 22 any sheet or sheets then present in it—e.g., after about 7 seconds, to open the circuit to the conveyor drive motor 10 from control line 70 through the potentiometer 62 while closing a circuit to motor 10 from line 70 through a resistance 68 having a magnitude preset to give the motor a greatly reduced speed. The reduced motor speed brings conveyor 6 to a low speed that can be as little as a crawl if sufficient to prevent damaging overheating of the conveyor by the high temperature heating of it as its passes through chamber 22.

Figure 8:
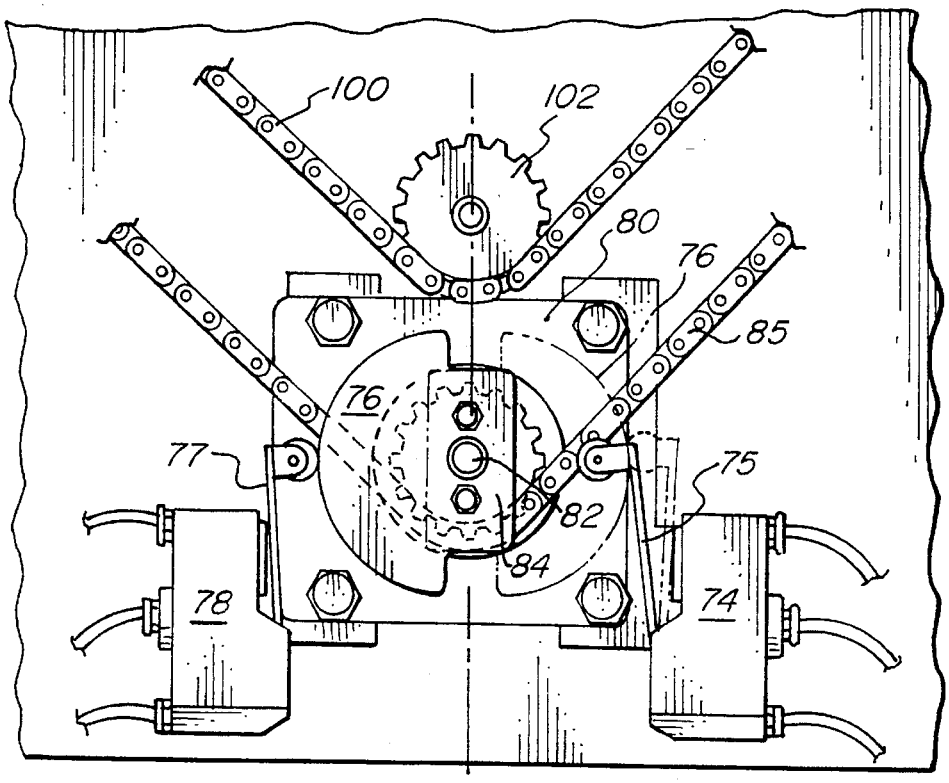
FIG. 8 is a view in enlarged scale of a motor for driving a chain and a cam by which limit switches are positioned to control the motor while the chain is displaced to turn cams that position the heating chamber doors.

Additionally, the time delay relay 66, upon switching of the conveyor motor speed control line 70 from a path through potentiometer 62 to a path through the preset resistance 68, also switches a current supply line 72 from a RUN mode path leading to the motors driving the vibrator 14, the hold down fan or blower 29 and the cooler fan 40, thus deenergizing these motors. Line 72 thus is also switched from connection with a line 72*a* extending to normally open contacts of a microswitch 74 controlled by a rotatable cam 76, to a STANDBY mode path leading via line 72*b* to contacts of a second microswitch 78 which at the time is being held closed by pressure of the cam 76 against its switch arm 77. The contacts of each microswitch lead to a heater door motor 80 (FIG. 8) having a shaft 82 that can turn the cam 76 and will correspondingly turn a sprocket 84 having teeth engaged with length 85 of a link chain serving functions as further described below.

As indicated by broken lines in FIG. 1 and shown more fully in FIGS. 4–7, the ends of the heating chamber 22 are each provided with a heat-insulating door 90 or 90B that normally is held in an idle position inside and above the adjacent end passageway 30 or 36 through which sheets on the conveyor flight 20 travel into or from the heating chamber; and each of these doors is movable downward to a closed position across such passageway to obstruct it so that little air can flow into or from the heating chamber when the doors 90 and 90B are closed.

Various ways of mounting and displacing the insulating heating chamber doors will be evident to skilled persons. In the illustrated embodiment, to which the invention is not limited otherwise than as required by appended claims, each door 90 or 90B is a hollow box-like member secured by brackets 91 to a shaft 92 supported in bearings mounted in the opposite side walls 23*a* and 23*b* of chamber 22. See FIG. 4. At the side of the machine opposite a side of it to be attended by an operator, each shaft 92 has an end thereof fixed to, and constitutes a fulcrum for, a door positioning lever 94. An arm 94*a* of each lever which protrudes away from its fulcrum is constantly pulled upward by a tension spring 95 having an upper end fixed to chamber wall 23*a*. The spring normally holds the related door 90 or 90B in an inactive position over the passageway 30 or 36, as indicated in FIG. 1 and FIG. 5.

An opposite arm 94*b* of each lever 94 carries a cam follower, e.g. a roller 96, which is constantly pressed by spring 95 against the periphery of a cam 97 of ovaloid shape (FIGS. 5 and 6) that can be turned by rotation of a sprocket 98 fixed to the cam's shaft 99. By a half-revolution of cam 97 its periphery and the follower 96 can be moved from a low posture in which the door 90 is held raised by spring 95, as seen in FIG. 5 with respect to the door at passageway 30, to a high posture in which the door has been moved down by cam 97 and lever 94 to its closed position as seen in FIG. 6.

Figure 5:
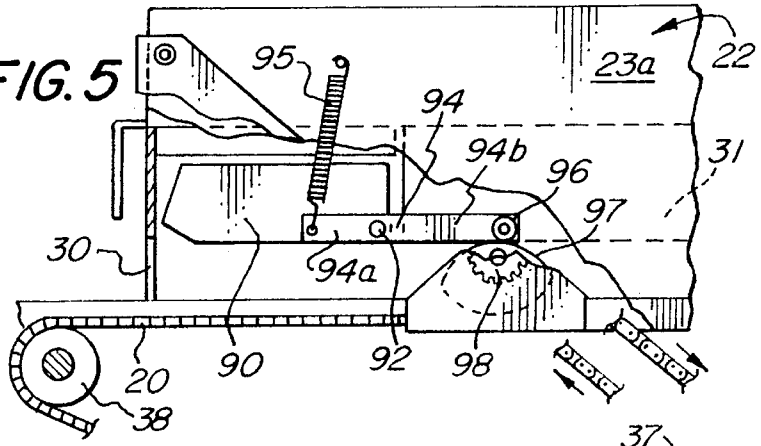
FIG. 5 is an elevational view, partly broken away and partly in section, showing the door at the infeed end of the heating chamber in its normal, open position.
Figure 6:
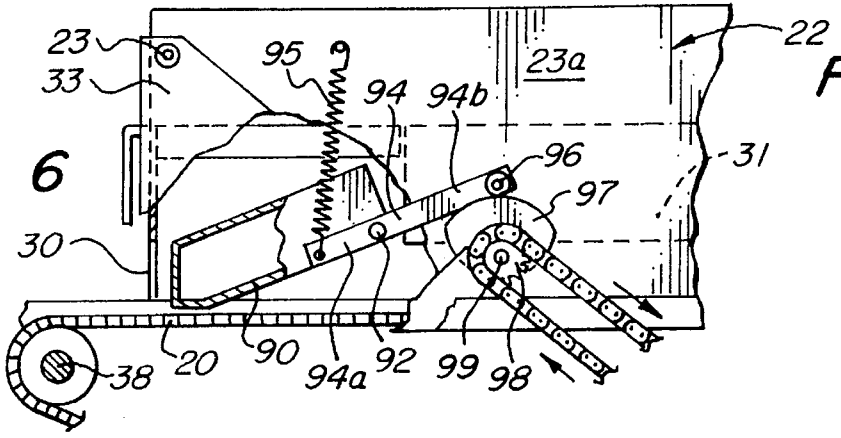
FIG. 6 is a view similar to FIG. 5, showing the same door in closed position.
Figure 4:
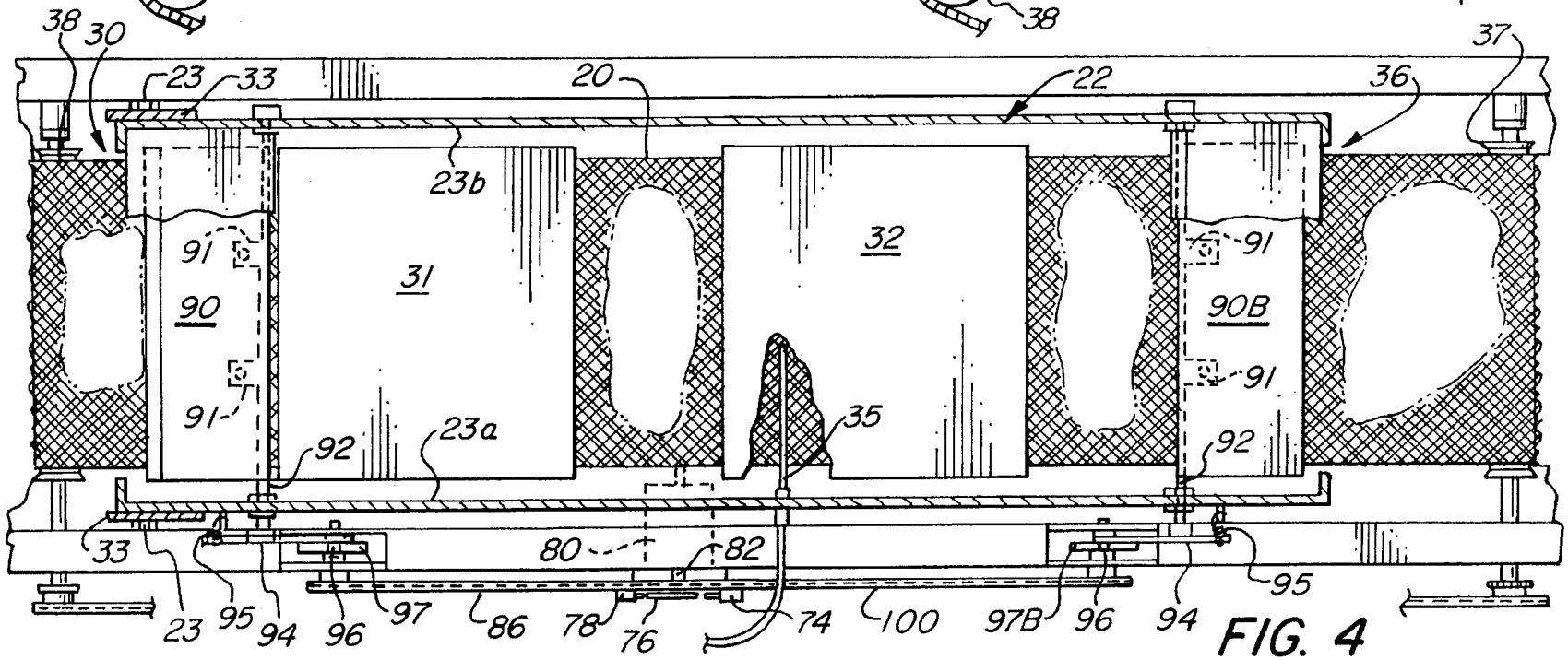
FIG. 4 is a horizontal cross-sectional view, partly broken away, taken approximately along line 4—4 of FIG. 1 to show the upper heaters and other parts in the heating chamber.
Figure 7:
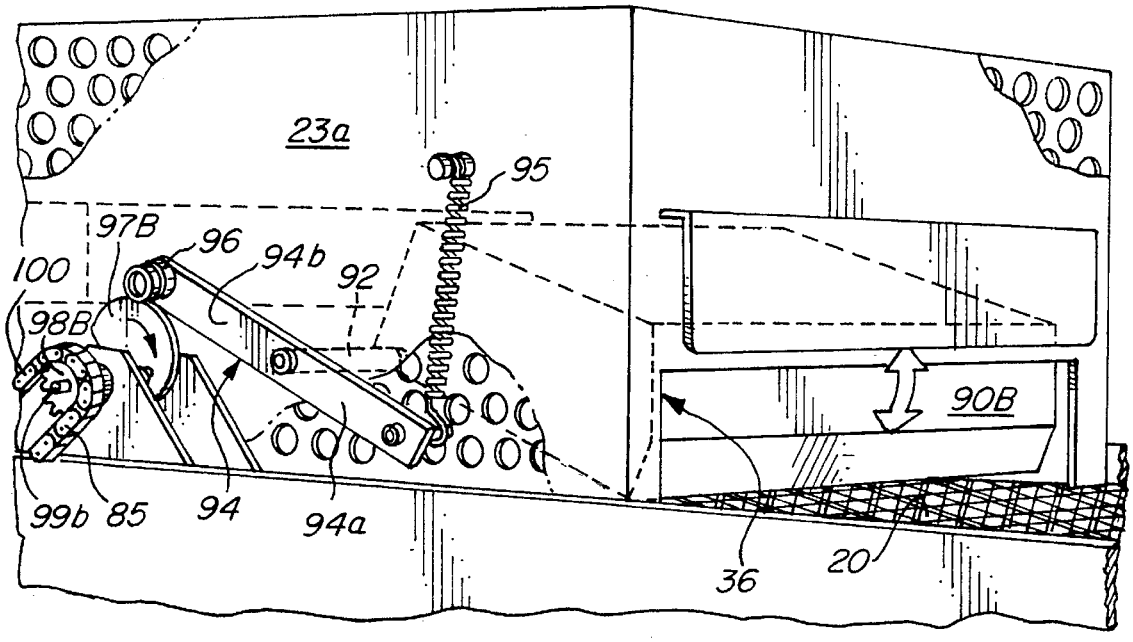
FIG. 7 is a perspective view showing the outfeed end of the heating chamber with its door in closed position.

The same functional relationships are provided in the positioning mechanism for the door 90B at the heaters' outfeed end opening 36, though preferably, as seen in FIGS. 4 and 7, in mirror-image relation to the parts shown in FIGS. 5 and 6. Thus at the outfeed end (FIG. 7), cam 97B, sprocket 98B and cam shaft 99B correspond to parts 97, 98 and 99 in FIGS. 5 and 6.

Reference has been made above to the driving of link chain length 85 by the sprocket 84 on shaft 82 of motor 80. Chain length 85 extends upward and forward from sprocket 84 to engage with and extend about the sprocket 98 that drives cam 97 to position the heating chamber's infeed end door 90. From sprocket 98 an upper length 100 of the chain extends down to and about an idler sprocket 102 located above sprocket 84 (FIG. 8), and thence backward and upward to engage with and extend about sprocket 98B (FIG. 7) that drives cam 97B to position the outfeed end door 90B. From sprocket 98B, the chain returns in length 85 to its motor driven driving sprocket 84.

Referring again to FIG. 3, the motor 80 for positioning the heater door is inactive when the RUN/STANDBY/AUTOMATIC switch 58 is in its RUN or its AUTOMATIC position with line 72 connected through time delay relay 66 and line 72*a* to the normally open microswitch 74. When relay 66 acts in delayed response to movement of switch 58 to STANDBY position, or in response to automatic deenergization of relay 73 by loss of current input through line 73*a*, thus switching the path of line 72 to line 72*b* and microswitch 78, motor 80 is then energized by current supplied through the cam-closed contacts of microswitch 78. Motor 80 then turns cam 76 and at the same time also turns sprocket 84 to drive chain length 85 until cam 76 has turned past and released arm 77 to open switch 78 and has pressed instead against a cam follower on arm 75 to close the contacts of micro-switch 74. The opening of switch 78 breaks the circuit to and stops motor 80.

Meanwhile, the displacement of chain length 85 by sprocket 84 has caused the chain to turn the door positioning cams 97 and 97B so that their high parts drive the doors 90 and 90B to closed position across the heating chamber passageways 30 and 36.

The closing of switch 74 prepares the system for again energizing door motor 80 when, due to a return of control switch 58 to its RUN mode setting, or, in its AUTOMATIC mode setting, due to a resumption of power input through line 73*a* and relay 73, the time delay relay 66 will be reset with resultant renewed connection of line 72 with motor 80 via switch 74. At that time, the reenergized motor 80 will turn cam 76 away from arm 75 to open switch 74 while again moving cam 76 back against arm 77 to close switch 78. This again deenergizes motor 80, but only after its chain driving sprocket 84 has again advanced the chain 85 by a distance sufficient to turn the door cams 97 and 97B by about a half revolution, thus now lowering them so that the springs 95 will lift the doors 90 and 90B up again to their normal idle position.

It will be noted that the heating chamber 22 comprises an elongate box-like upper structure that contains the upper heaters 31 and 32 and the doors 90 and 90B and has its side walls 23*a* and 23*b* hinged at one end near their top, as by pins 23, to rigid brackets 33 which are fixed to the frame of the machine. This upper structure can easily be swung upward and back in place about the hinge pins 23, giving easy access to the heaters, the doors, thermocouple 35 and the wire mesh conveyor 6. In such swinging movement the door positioning levers 94 and springs 95 are moved freely away from and back to working position in relation to their respective positioning cams 97 and 97B.

It is also to be noted that the box-like upper heating chamber structure 22 normally includes in well known manner heat-insulating inner side and top walls having foraminous metal screens overlying and spaced from them to protect persons working at or observing operations of the machine from injury by contact with the hot inner walls.

The invention herein set forth enables extraordinarily accurate control of the high heating temperature to be maintained in the heating chamber of the thermography machine during its operations for processing sheets and during its standby periods when the machine stands idly awaiting supplies of sheets to be processed. Moreover, very substantial savings are realized, amounting in all to as much as 40% or 50% of usual power consumption costs in comparable thermography machine operations, by the reductions during standby periods of heat losses in air flows from and into the heating chamber, and from it as induced by a sheet hold down blower or fan, and by reductions of the heat lost by being carried out in the wire mesh of the conveyor leaving the heating chamber; and, further, by the reductions during standby periods of the power usage and the wear and deterioration usually involved in the driving of conveyors, fans, and a powder applying and recycling system of the machine. Yet the machine is always ready for resumption of its normal run mode of operation without significant delay.

The particulars of the invention as described hereinabove and illustrated in the drawings are subject to many changes, including omissions and substitutions of parts by persons skilled in the art, without departing from the principles herein disclosed. The invention is intended to be defined by the appended claims, and is not to be restricted to such particulars except as may be required for fair construction of the claims.

I claim:

1. In a thermography process running on thermography equipment wherein sheets bearing image areas overlaid with thermoplastic powder particles are transported successively at a first rate of transport energy input through a heating chamber radiantly heated at a first rate of heater energy input to fuse together such particles on each sheet, and then through a station for cooling fused image portions on the sheets, in which process periods of non-use occur with the thermography equipment readied for processing such sheets but awaiting supply of them to be processed, the method which comprises during said non-use periods maintaining in the heating chamber a temperature sufficient for fusing said particles onto such sheets whenever passed through the heating chamber at said first transport energy input rate yet holding the energy input to said thermography equipment to a second heater energy input rate lower than the first heater energy input rate and holding the transport energy input rate to a second transport energy input rate lower than the first transport energy input rate.

2. A process according to claim 1, comprising during periods of use driving through said heating chamber at the first transport energy input rate an endless conveyor provided for transporting the sheets therethrough, and during periods of non-use driving said second conveyor at the slower second transport energy input rate that is sufficiently fast to prevent damage to the conveyor by the heating of it as it passes through said chamber.

3. A process according to claim 1, comprising during said periods of non-use holding substantially closed a passageway for sheets transport that normally is open at an end of said heating chamber, thus obstructing escape of heat from said chamber.

4. A process according to claim 1, comprising during said periods of non-use holding substantially closed passageways for sheets transport that normally are open at the infeed end and the outfeed end of said heating chamber, thus obstructing escape of heat from said heating chamber.

5. A process according to claim 1, comprising providing a powder hopper vibrator for said thermoplastic powder and holding substantially cut off during said periods of non-use supplies of power said powder hopper vibrator comprised in said equipment.

6. In a thermography process running on thermographic equipment wherein sheets bearing image areas overlaid with thermoplastic powder particles are transported successively at a first transport rate through a heating chamber heated at a first rate of energy input to fuse together such particles on each sheet, and then through a cooling chamber for cooling fused image portions on the sheets, in which process periods of non-use occur with the thermographic equipment readied for processing such sheets but awaiting supply of them to be processed, the method which comprises during said non-use periods maintaining in the heating chamber a temperature sufficient for fusing said particles onto such sheets whenever passed through the heating chamber at said first transport rate, holding substantially closed passageways for sheets transport that normally are open at the infeed and the outfeed ends of said heating chamber, thus obstructing escape of heat from the heating chamber, and driving through said heating chamber the upper flight of an endless conveyor provided for transporting the sheets therethrough, the conveyor's speed reduced to a second transport rate slower than said first transport rate but sufficient to prevent damage to the conveyor by the heating of it as it passes through the heating chamber.

7. A process according to claim 6, further providing a powder hopper vibrator for said thermoplastic powder and holding substantially cut off during said periods of non-use supplies of power to said powder vibrator comprised in said equipment.

8. In a thermography machine including a heating chamber containing electrical heating means for heating sheets passed successively through said chamber to a temperature sufficient to fuse together and to each sheet thermoplastic powder particles overlying image areas of the sheet, a cooling chamber wherein each heated sheet is cooled to solidify fused image portions thereon and conveyor means for transporting the sheets through said a motor variable in speed for driving said conveyor means, heat control means for activating said heating means to maintain continually in said heating chamber a preset temperature suited for fusing said powder particles onto such sheets during passage of the sheets through the heating chamber, a control circuit to be disposed in a state establishing a standby mode of operation during non-use of the machine when the machine readied for processing sheets stands awaiting supply of sheets to be processed, and a speed control responsive to disposal of said control circuit in standby mode for causing said motor to drive said conveyor means at a reduced speed.

9. A thermography machine according to claim 8, said motor being a D.C. electric motor driven at a speed determined by the supplied voltage, said speed control including means for imposing an increased, preset resistance in a circuit controlling the power supply to said motor.

10. A thermography machine according to claim 8, said heating chamber having at opposite ends thereof passageways that normally are open for transport of the sheets therethrough, at least one of said passageways having a door that is movable to a closed position thereacross to obstruct escape of heat from the heating chamber when the machine is operating in standby mode.

11. A thermography machine according to claim 8, said heating chamber having at opposite ends thereof passageways that normally are open for transport of the sheets therethrough, each of said passageways having a door that is movable to a closed position thereacross to obstruct escape of heat from the heating chamber when the machine is operating in standby mode.

12. A thermography machine according to claim 11, and door positioning means for moving said doors in unison to their respective closed positions in response to disposal of said control circuit in standby mode.

13. A thermography machine according to claim 12, said control circuit further including time delay means rendered operative upon disposal of said control circuit in standby mode for delaying the reduction of the speed of said conveyor means and the closing movement of said doors during a preset time interval sufficient for any sheet then present in said heating chamber to be transported out of it by said conveyor means.

14. A thermography machine according to claim 8, further comprising a powder hopper vibrator and fan motors, and said control circuit further including means operative during said periods of non-use to cut off power supply to said motors of fans and said powder hopper vibrator.

15. A thermography machine according to claim 12, said door positioning means including for each of said doors a lever having an arm swingable to move the door to and away from closed position, means normally holding the arm in a position disposing the door away from closed position, and means for swinging the arm to move the door to closed position in response to disposal of said control circuit in standby mode.

16. A thermography machine according to claim 15, each said arm swinging means comprising a cam follower on a said lever, a rotatable cam slidably engageable with said cam follower and turnable to displace it, a sprocket turnable to turn said cam, a link chain engaged with teeth of said sprocket and a door motor having a sprocket for driving said chain.

17. A thermography machine according to claim 16, said link chain being common to and having a respective length thereof engaged with the said cam turning sprocket for each of said doors, said motor sprocket having teeth engaged with said chain and being turnable by said motor for displacing said chain to turn the respective cams of said arm swinging means correspondingly and in unison.

18. A thermography machine according to claim 8 said heat control means including a thermocouple positioned in said heating chamber and adapted to respond to a preset high temperature therein, a thermocouple heat control rendered operative to transmit current energizing said heating means in response to a temperature deficiency sensed by said thermocouple, and a proportional heat control operative to vary on/off cycles of the power supplied from an A.C. power supply line to said thermocouple heat control and thus control the wattage output to said heating means in proportion to variations of the voltage in said supply line.

19. A thermography machine according to claim 8, for processing sheets delivered imprinted by a printing press associated with said machine, said control circuit including switch means responsive to a condition that exists upon a cessation of the operation of said printing press to cause disposal of said circuit in the standby mode when the press ceases imprinting sheets.

20. A thermography machine according to claim 19, said switch means being operative in response to resumption of the operation of said printing press to establish in said control circuit a normal run mode of operation of said machine.

21. A thermography machine according to claim 19, said switch means comprising a relay operative to cause disposal of said circuit in the standby mode in response to deenergization of a current supply line that delivers power to energize a sheets feeding means of said press when said press is operating, said relay being operative to restore in said circuit a normal run mode of operation of said machine upon reenergization of said current supply line.

22. A thermography machine including a heating chamber, a cooling chamber, and a flight of an endless conveyor extending and movable through the chambers for transporting therethrough sheets bearing thermoplastic powder particles to be fused together in said chamber to form raised image portions on the sheets, said heating chamber having infeed and outfeed end openings that normally are open for passage therethrough of said conveyor flight with sheets thereon, each of said openings having a door movable across it to obstruct escape of heat from said heating chamber during standby periods of the machine's operation in which the machine though readied for processing such sheets stands awaiting supply of sheets to be processed, door positioning means for moving each of said doors to and away from closed position across the related chamber end opening, each said positioning means including a lever having an arm carrying and swingable to displace the door, means normally biasing said lever to a position in which the door is held away from the related chamber end opening, and means operable in each of said standby periods for displacing the lever so that it moves the door to closed position.

23. A thermographic machine according to claim 22, each of said doors being positioned by means normally holding the door away from the related end opening yet displaceable to move the door to a closed position across said opening, and drive means common to said displaceable means for moving said doors in unison to and away from their respective closed positions.

24. A thermography machine according to claim 22, each said positioning means further including a cam follower on each said lever, a rotatable cam slidably engaging said cam follower to displace it, a sprocket for turning said cam and a link chain engaging teeth of said sprocket and displaceable to turn it and said cam.

25. In a thermography machine including a heating chamber containing electrical resistance heaters for heating sheets passed successively through said chamber to a temperature sufficient to fuse together and to each sheet thermoplastic powder particles overlying image areas of the sheet, a cooling chamber wherein each heated sheet is cooled to solidify fused image portions thereon, conveyor means for transporting the sheets through said chambers, and heat control means for activating said heaters to maintain continually in said heating chamber a preset high temperature suited for fusing said powder particles onto such sheets during passage of the sheets through the heating chamber, said heat control means including a thermocouple positioned in said heating chamber and adapted to respond to a preset high temperature therein, a thermocouple heat control rendered operative to transmit current energizing said heating means in response to a temperature deficiency sensed by said thermocouple, and a proportional heat control operative to vary on/off cycles of the power supplied from an A.C. power supply line to said thermocouple heat control and thus control the wattage output to said heating means in proportion to variations of the voltage in said supply line.

* * * * *